US011465870B2

(12) United States Patent
Latsko

(10) Patent No.: US 11,465,870 B2
(45) **Date of Patent: *Oct. 11, 2022**

(54) SYSTEM FOR A PRINTER EXTENSION KIT

(71) Applicant: John Latsko, Chandler, AZ (US)

(72) Inventor: John Latsko, Chandler, AZ (US)

( * ) Notice: Subject to any disclaimer, the term of this patent is extended or adjusted under 35 U.S.C. 154(b) by 80 days.

This patent is subject to a terminal disclaimer.

(21) Appl. No.: 16/994,394

(22) Filed: Aug. 14, 2020

(65) Prior Publication Data

US 2020/0377325 A1 Dec. 3, 2020

Related U.S. Application Data

(63) Continuation-in-part of application No. 29/739,463, filed on Jun. 25, 2020, which is a continuation-in-part of application No. 16/164,787, filed on Oct. 18, 2018, now Pat. No. 10,752,460.

(60) Provisional application No. 62/573,937, filed on Oct. 18, 2017.

(51) Int. Cl.

| | |
|---|---|
| ***B65H 31/20*** | (2006.01) |
| ***B41J 11/00*** | (2006.01) |
| ***B65H 5/36*** | (2006.01) |
| ***B65H 1/04*** | (2006.01) |

(52) U.S. Cl.

CPC ..... *B65H 31/20* (2013.01); *B41J 11/0055* (2013.01); *B65H 1/04* (2013.01); *B65H 5/36* (2013.01); *B65H 2402/10* (2013.01); *B65H 2402/32* (2013.01); *B65H 2405/1122* (2013.01); *B65H 2405/11161* (2013.01); *B65H 2405/11164* (2013.01); *B65H 2801/06* (2013.01)

(58) Field of Classification Search

CPC ..... B65H 31/20; B65H 2405/11164; B65H 2405/1122; B65H 2405/112; B65H 2405/11161

See application file for complete search history.

(56) References Cited

U.S. PATENT DOCUMENTS

| | | | | |
|---|---|---|---|---|
| D317,173 | S | 5/1991 | Kojima | |
| D357,273 | S | 4/1995 | Hocking | |
| 5,613,672 | A * | 3/1997 | Tanaka | B41J 13/10 271/223 |
| 6,106,178 | A | 8/2000 | Chiu | |
| D434,794 | S | 12/2000 | Bokelman | |
| D435,062 | S | 12/2000 | Alvarez | |

(Continued)

FOREIGN PATENT DOCUMENTS

EP 1306224 A2 5/2003

*Primary Examiner* — Jeremy R Severson

(57) ABSTRACT

A printer extension kit that modifies a printer to receive and output longer pieces of paper. The printer extension kit includes an input extension part, an output extension part, and an output extension clip. The paper tray of a printer is extended by the input extension part allowing the printer to hold longer pieces of paper. The input extension part is attached to the paper tray of a printer. The output extension part allows a printer to output longer pieces of paper. In more detail, the output extension part prevents longer pieces of paper from falling of the catch tray of a printer. The output extension part is attached into the catch tray of a printer. The output extension clip provides another means for a printer to output longer pieces of paper. In more detail, the output extension clip is attached along the output paper catch of a printer.

7 Claims, 12 Drawing Sheets

(56) References Cited

U.S. PATENT DOCUMENTS

| | | | | |
|---|---|---|---|---|
| 6,227,536 | B1 | 5/2001 | Bethke | |
| 10,053,310 | B2 | 8/2018 | Nishiyama | |
| 10,065,828 | B2 | 9/2018 | Takeuchi | |
| 10,752,460 | B2 * | 8/2020 | Latsko | B65H 1/04 |

* cited by examiner

SYSTEM FOR A PRINTER EXTENSION KIT

The current application is a continuation-in-part (CIP) application of the U.S. non-provisional design application Ser. No. 29/739,463 filed on Jun. 25, 2020. The U.S. non-provisional design application Ser. No. 29/739,463 is a CIP application of the U.S. non-provisional application Ser. No. 16/164,787 filed on Oct. 18, 2018. The U.S. non-provisional application Ser. No. 16/164,787 claims a priority to the U.S. Provisional Patent application Ser. No. 62/573,937 filed on Oct. 18, 2017 and a priority to the U.S. Provisional Patent application Ser. No. 62/658,451 filed on Apr. 16, 2018.

FIELD OF THE INVENTION

The present invention relates generally to printers and printer accessories. More specifically, the present invention is a tray extension which allows a printer to receive and output longer pieces of paper.

BACKGROUND OF THE INVENTION

Printers, copiers, and related devices have been essential tools for business and residential use. In general, printers are peripheral devices connected to a computer or similar device to allow users to make physical representations on paper or similar material of graphics or text. Most printers comprise a number of trays on which stacks of paper are placed to be feed into the printer. In addition, one or more trays are positioned at the exit of the printer to receive the printed pages. It is common for many printers to have a number of trays of fixed length and width so only a specific size of paper can be used with the printers. Newer printers offer more functional trays which offer a way to accommodate different sizes of papers. While these newer trays provide more functionality than older trays, few or none provide ways to extend the length of the trays to accommodate longer sizes of paper. More importantly, there are few or none alternative methods to extend the functionality of the trays of printers, especially the OKI data printers. More specifically, the OKI B432dn printer is a printer built for maximum speed and efficiency which offers a main tray with a slide which allows paper sizes of 8.5 inches by 11 inches and 8.5 inches by 14 inches to be used. However, if one were to use a paper longer than 14 inches, the paper would not fit the main tray and the paper could be jammed in the printing process. In addition, the catching tray of the OKI B432dn printer would not be able to receive and hold a paper longer than 14 inches. Therefore, a device or method which allows the user to utilize the OKI B432dn printer with paper longer than 14 inches is necessary and beneficial.

An objective of the present invention is to provide a tray extension kit for the OKI B432dn printer or for any other kind of OKI printer. Another objective of the present invention is to provide a tray extension kit which allows the user to utilize paper longer than 14 inches with the OKI B432dn printer. Another objective of the present invention is to provide a tray extension kit for the OKI B432dn printer which is easy to install and easy to use. Another objective of the present invention is to provide a tray extension kit for the OKI B432dn printer which does not require the user to modify or alter the structure of the OKI B432dn printer. Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention.

DETAIL DESCRIPTIONS OF THE INVENTION

All illustrations of the drawings are for the purpose of describing selected versions of the present invention and are not intended to limit the scope of the present invention.

Figure 1A:
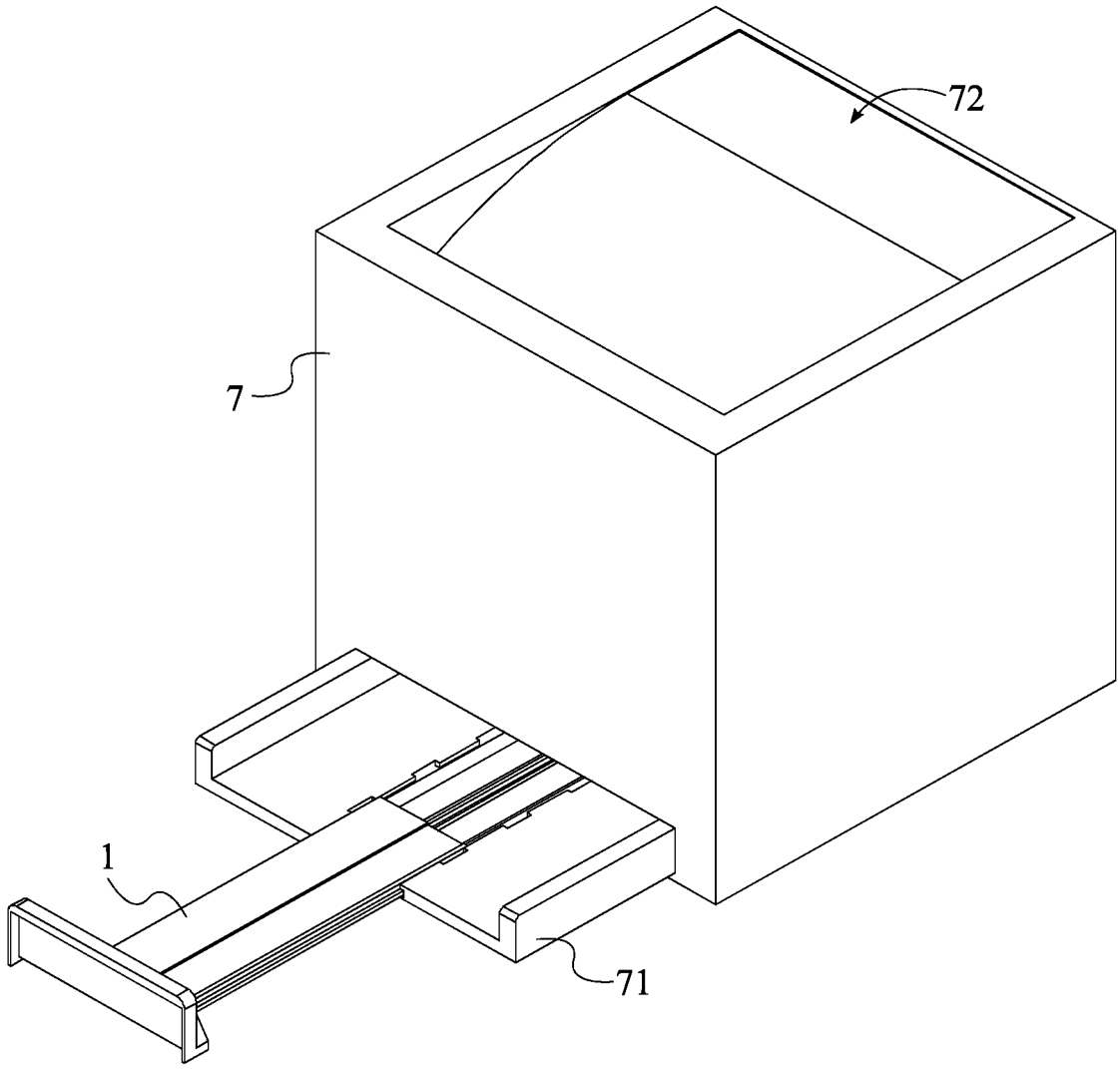
FIG. 1A is a perspective view of the input extension part in use with the desktop printer.
Figure 1B:
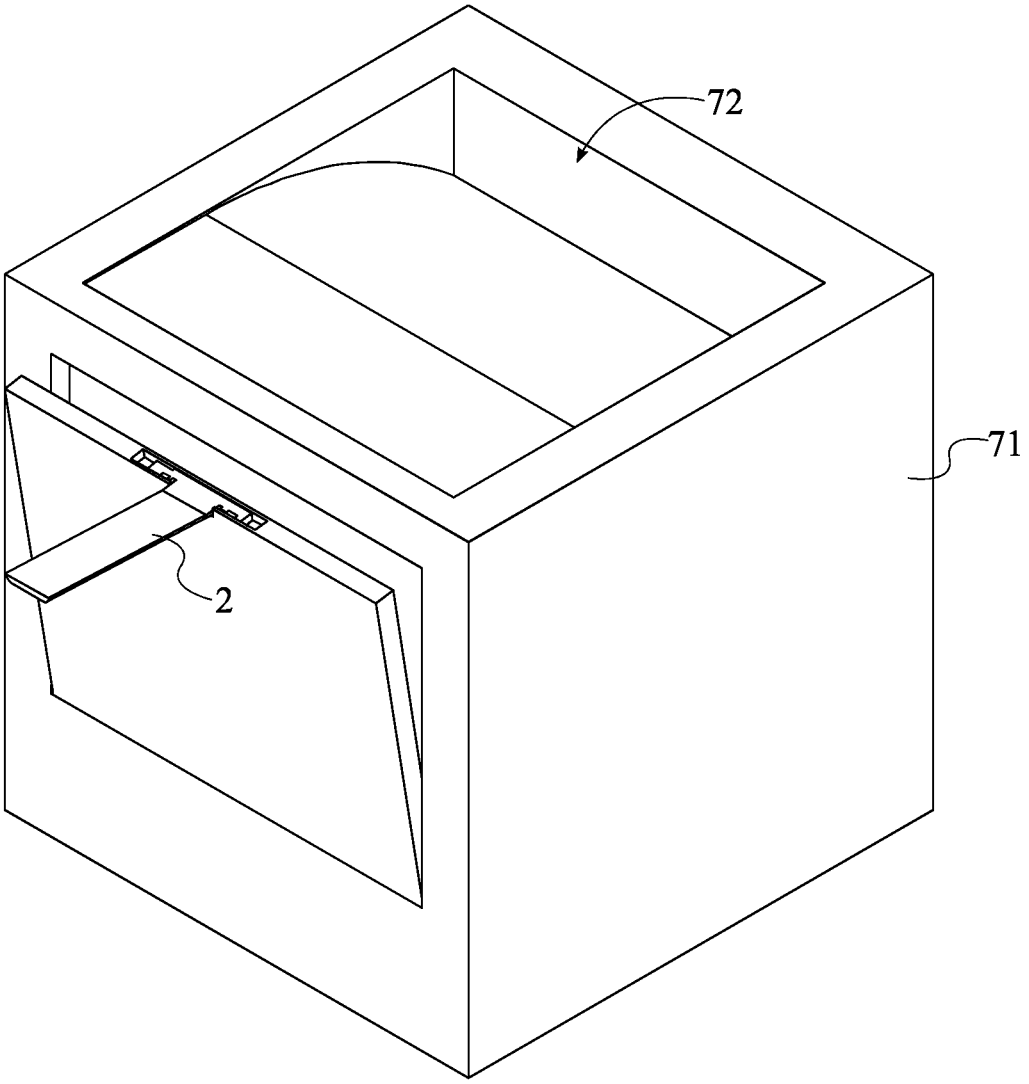
FIG. 1B is a perspective view of the output extension part in use with the desktop printer.
Figure 9:
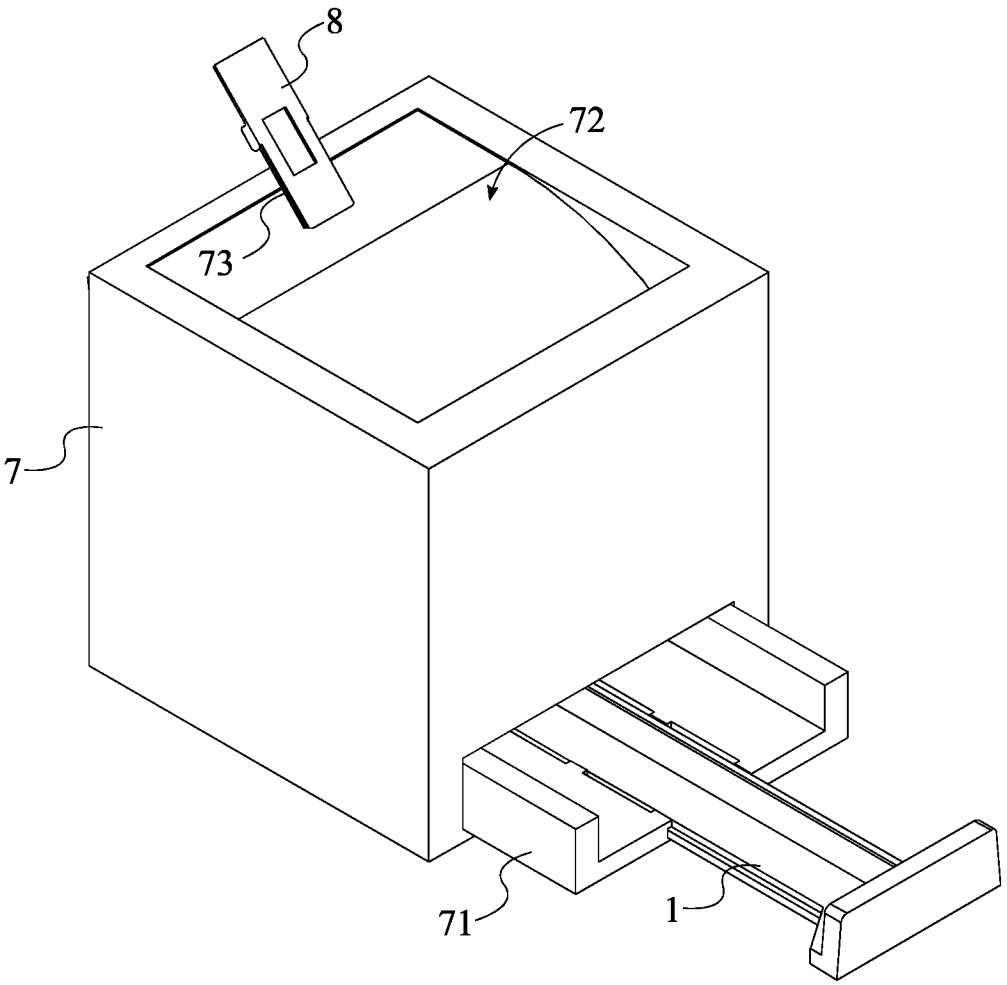
FIG. 9 is a perspective view of the output extension clip in use with the desktop printer.

As can be seen in FIGS. 1A and 1B, the present invention is a system for a printer extension kit. The present invention retrofits a printer to print longer pieces of paper than the standard pieces of paper. The present invention comprises a desktop printer 7, an input extension part 1, an output extension part 2, and an output extension clip 8. The desktop printer 7 preferably used in the present invention is the OKI B432dn printer, and the present invention retrofits the OKI B432dn printer to print pieces of paper longer than 14 inches and up to a length of 20 inches. The desktop printer 7 can also be any other kind of OKI printer. The desktop printer 7 comprises a paper tray 71, a catch tray 72, and an output paper catch 73. The paper tray 71 is used to retain pieces of blank paper, while the catch tray 72 is used to retain pieces of printed paper. The output paper catch 73 is another means for the desktop printer 7 to retain pieces of printed paper. The input extension part 1 retrofits the paper tray 71 in order to retain longer pieces of blank paper. Similarly, the output extension part 2 retrofits into the catch tray 72 in order for the desktop printer 7 to retain longer pieces of printed paper. With reference to FIG. 9, the output extension clip 8 can be attached along the output paper catch 73 in order for the desktop printer 7 to retain longer pieces of printed paper.

Figure 2:
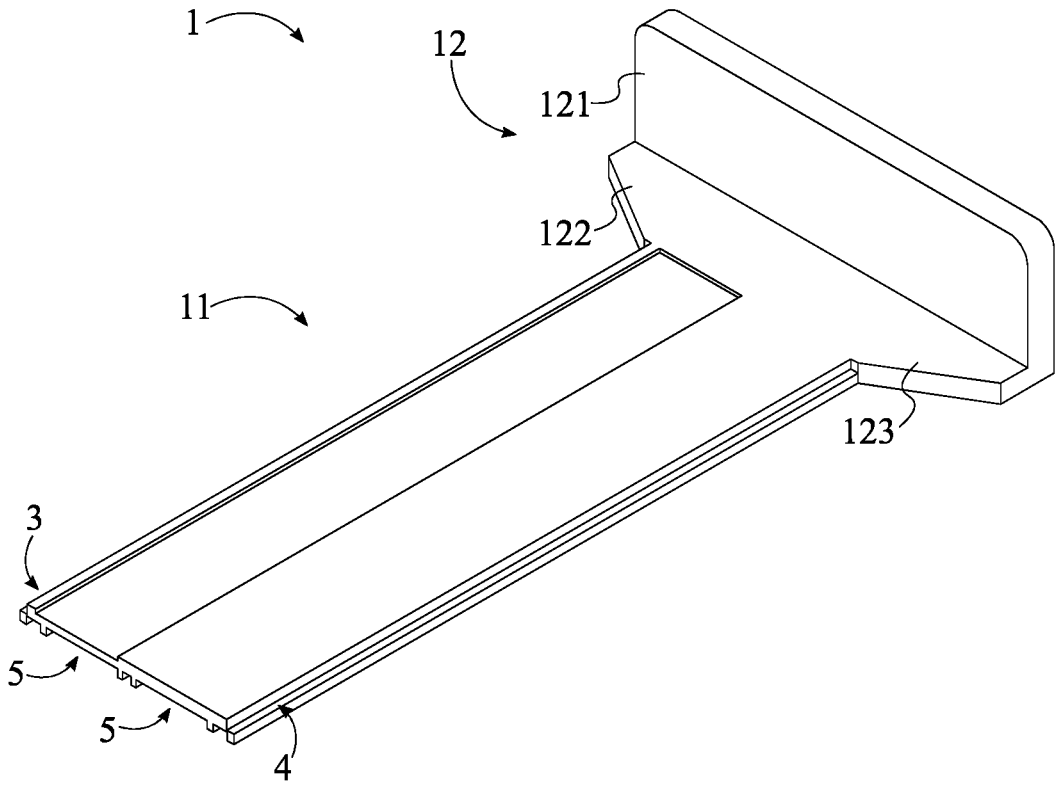
FIG. 2 is a top perspective view of the input extension part.
Figure 5:
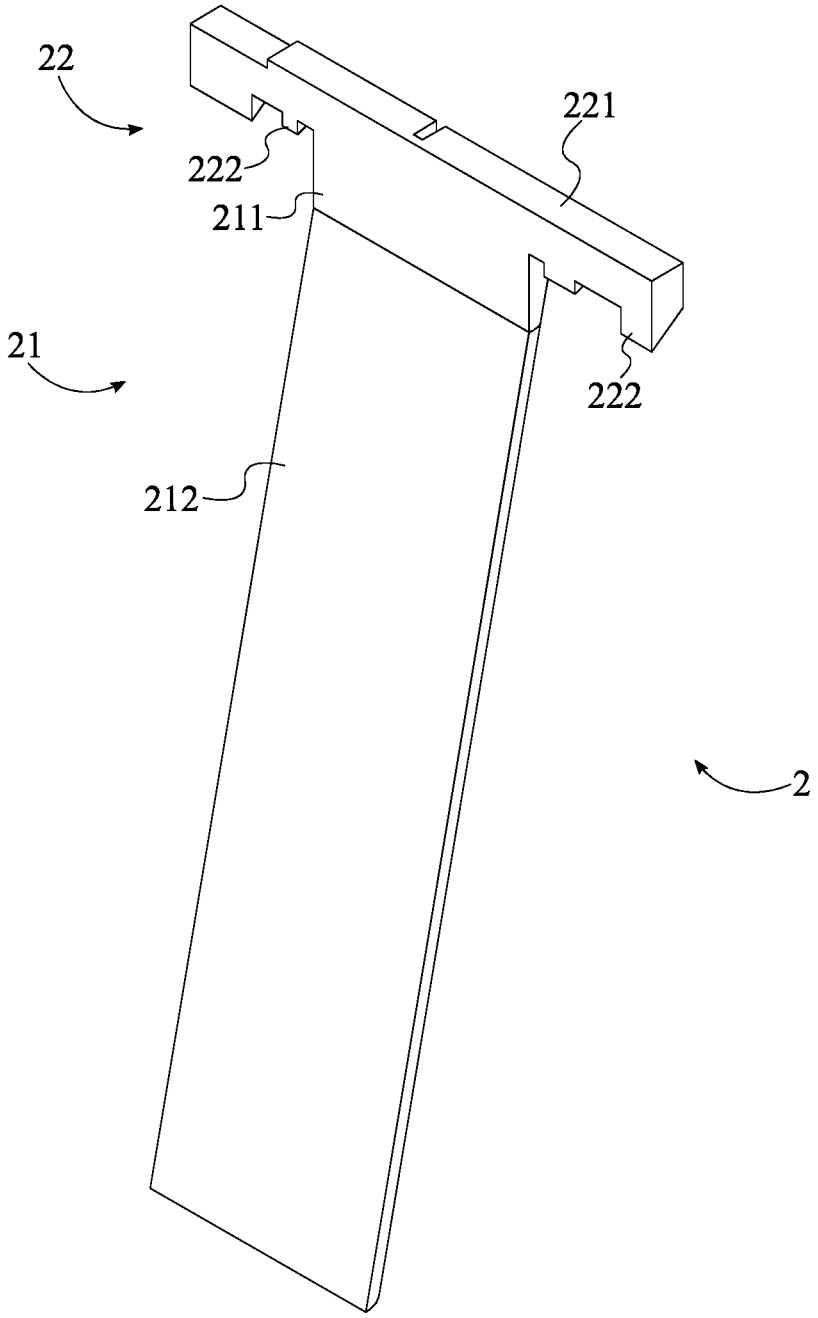
FIG. 5 is a front perspective view of the output extension part.

The general configuration of the aforementioned components allows the present invention to effectively and efficiently retrofit a printer to handle longer pieces of paper. As can be seen in FIG. 2, the input extension part 1 comprises an input elongated member 11 and an input head 12. The input elongated member 11 laterally traverses into the paper tray 71 so that the input extension part 1 is able to increase the total resting area on the paper tray 71 for a longer piece of blank paper. The input head 12 is also terminally connected to the input elongated member 11, which allows the input head 12 to peripherally brace a longer piece of the blank paper within the paper tray 71. In addition, the input elongated member 11 is used to guide the movement of the input extension part 1 across the paper tray 71, and, thus, the input elongated member 11 is slidably engaged across the paper tray 71. Likewise, the output elongated member 21 comprises an output elongated member 21 and an output head 22, which is shown in FIG. 5. The output elongated member 21 is peripherally positioned to the catch tray 72 so that the output extension part 2 is able to increase the total resting area on the catch tray 72 for a longer piece of printed paper. The output head 22 is also terminally connected to the output elongated member 21 so that the output head 22 is able to laterally mount to the catch tray 72. The output head 22 preferably mounts into a lateral edge of an access panel that is positioned adjacent to the catch tray 72 of the OKI B432dn printer.

Figure 4:
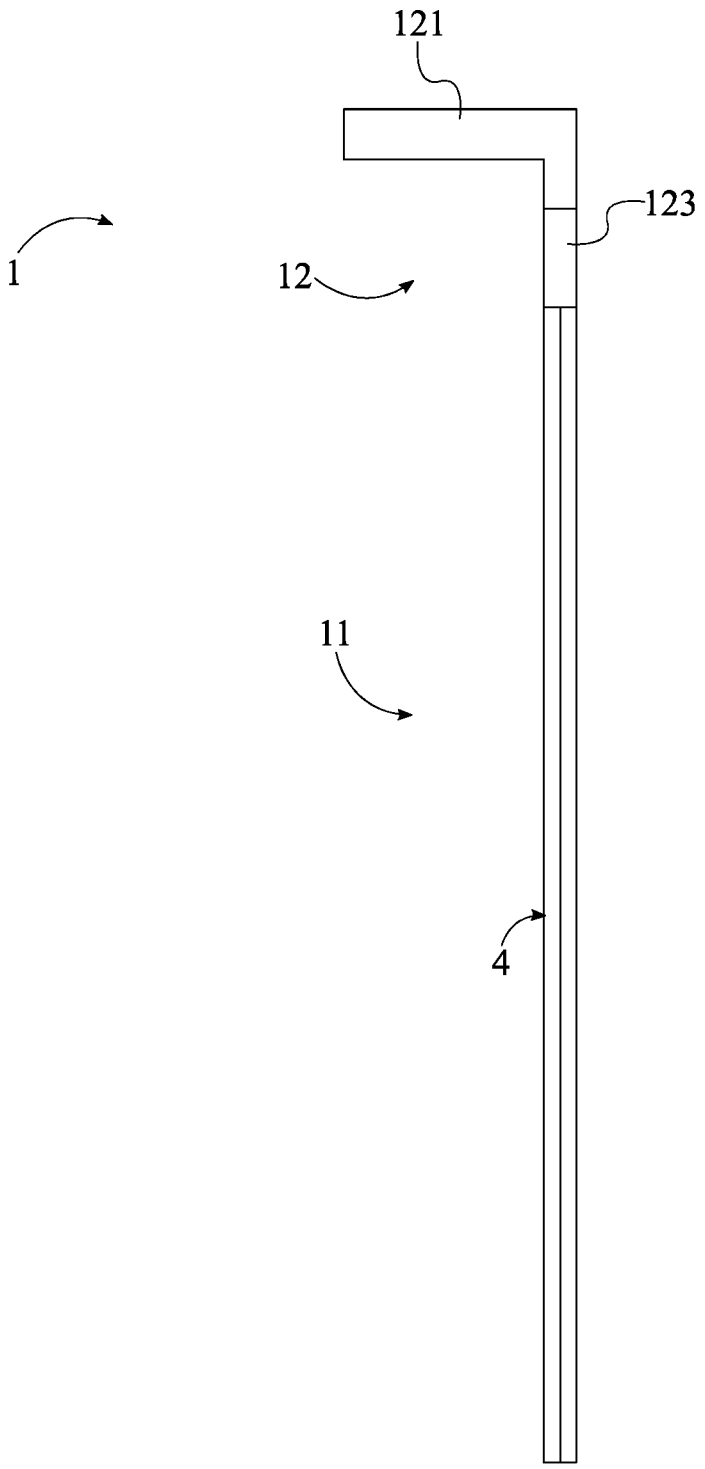
FIG. 4 is a right-side view of the input extension part.

In order to properly brace a stack formed by longer pieces of blank paper, the input head 12 may further comprise a stop panel 121, a first counterfort 122, and a second counterfort 123, which is shown in FIGS. 2 and 4. The stop panel 121 allows the input head 12 to brace the stack formed by the longer pieces of blank paper with a rigid flat surface. The input elongated member 11 is positioned normal to the stop panel 121 and is peripherally connected to the stop panel 121, which positions the stop panel 121 to stabilize the stack formed by longer pieces of blank paper within the paper tray 71. Moreover, the first counterfort 122 is connected in between the input elongated member 11 and the stop panel 121 in order to structurally reinforce the connection between the input elongated member 11 and the stop panel 121. Similarly, the second counterfort 123 is connected in between the input elongated member 11 and the stop panel 121 in order to structurally reinforce the connection between the input elongated member 11 and the stop panel 121. The first counterfort 122 and the second counterfort 123 are positioned opposite to each other about the input elongated member 11 so that the stop panel 121 is able to evenly distribute any loads onto the input elongated member 11.

Figure 3:
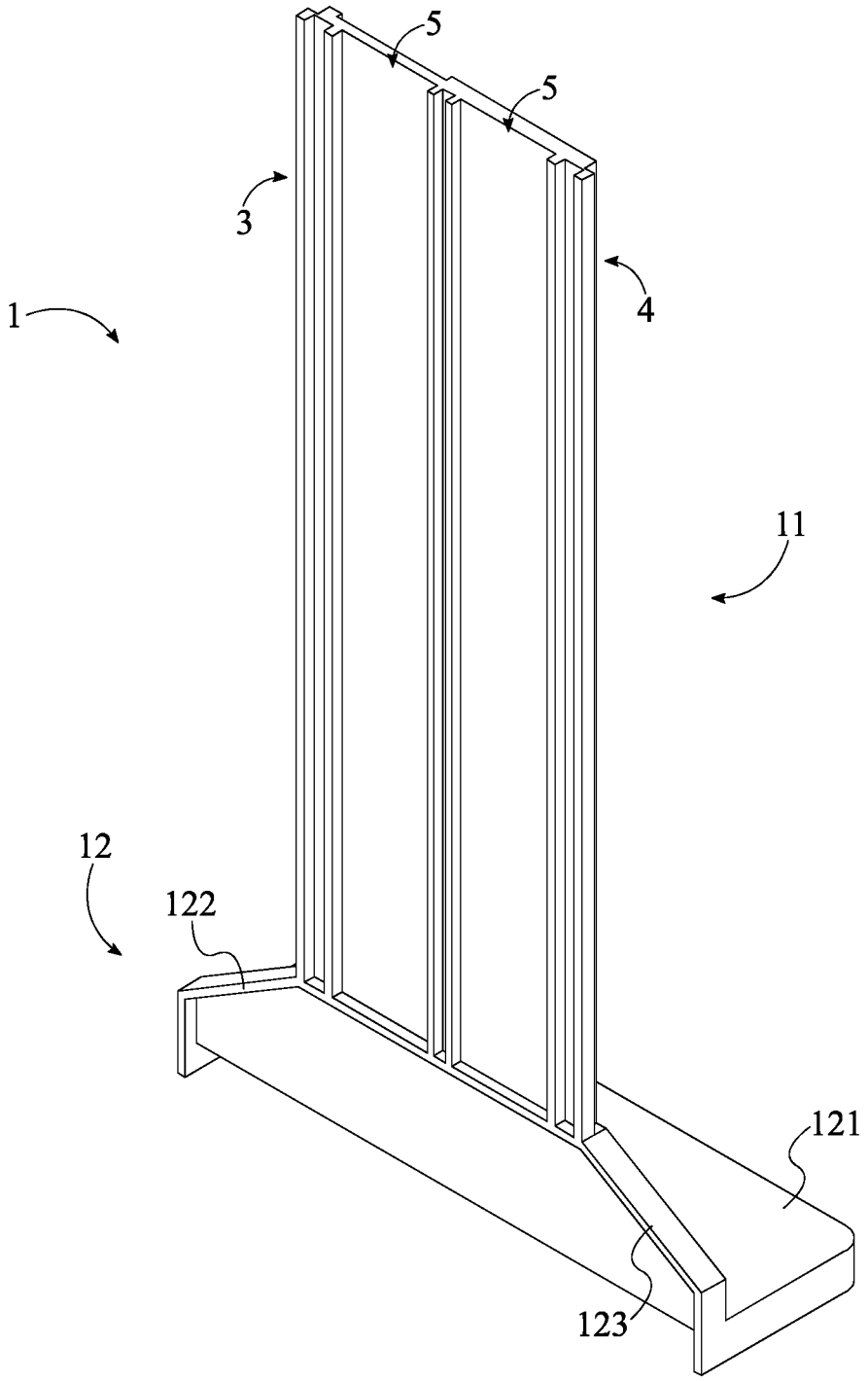
FIG. 3 is a bottom perspective view of the input extension part.

In order to properly guide the movement of the input extension part 1 across the paper tray 71, the present invention may further comprise a first guide track 3, a second guide track 4, and a plurality of guide channels 5, which is shown in FIGS. 2 and 3. The first guide track 3 and the second guide track 4 are laterally integrated along the input elongated member 11 and are positioned opposite to each other about the input elongated member 11 so that the first guide track 3 and the second guide track 4 are able to evenly brace the input extension part 1 as the input extension part 1 moves across the paper tray 71. In addition, the first guide track 3 and the second guide track 4 are slidably engaged by the paper tray 71, which allows the input extension part 1 to readily move across the paper tray 71. The first guide track 3 and the second guide track 4 are preferably and respectively engaged by two opposing sets of interspersed protrusions that are integrated into the paper tray 71 of the OKI B432dn printer. Moreover, the plurality of guide channels 5 provides a secondary source of guidance and stability for the movement of the input extension part 1 across the paper tray 71. The plurality of guide channels 5 is positioned parallel to, coplanar with, and offset from each other and is laterally integrated along the input elongated member 11. This arrangement for the plurality of guide channels 5 is able to distribute this secondary source of guidance and stability for anywhere in between the first guide track 3 and the second guide track 4. The plurality of guide channels 5 is slidably engaged onto the paper tray 71 by preferably and respectively receiving of a set of guide rails that are integrated onto the paper tray 71 of the OKI B432dn printer.

Figure 8:
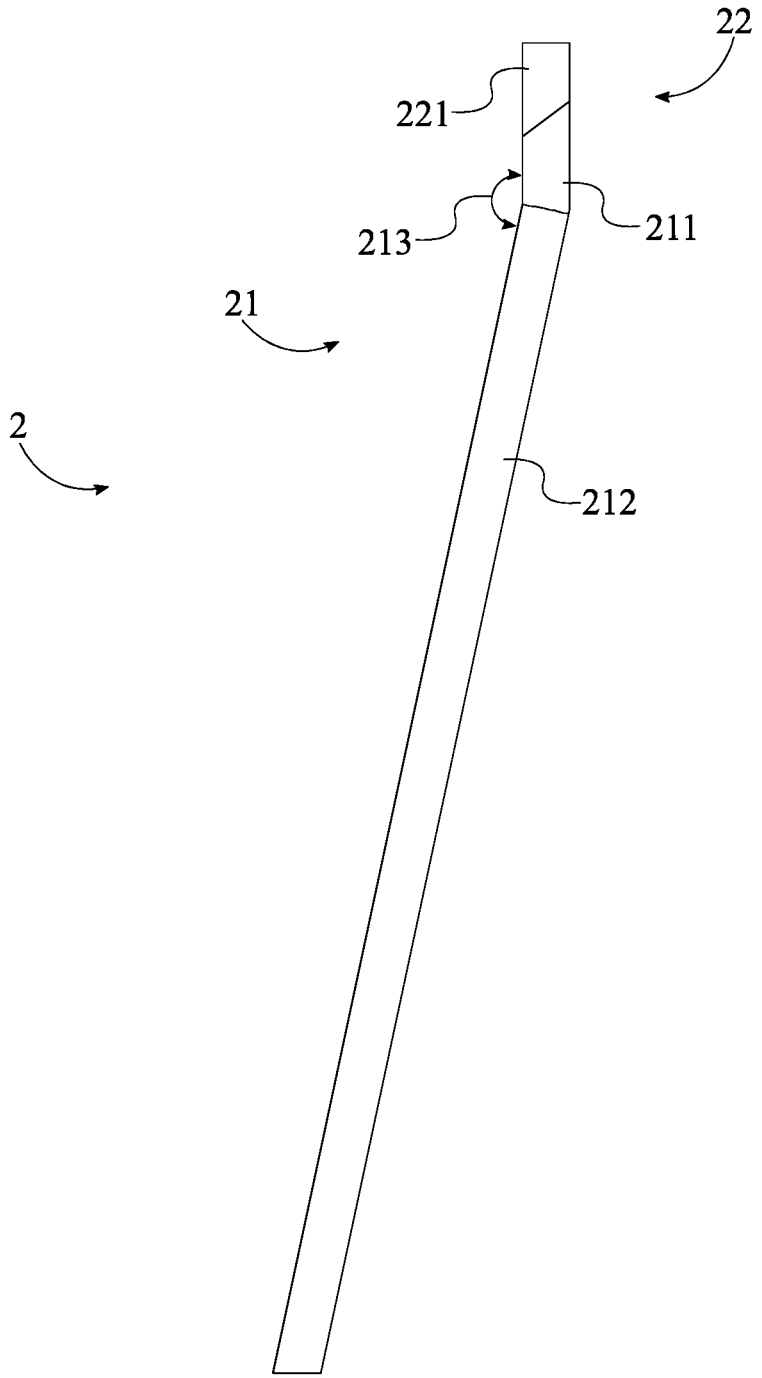
FIG. 8 is a right-side view of the output extension part.

In order to prevent a longer piece of printed paper from falling out of the catch tray 72, the output elongated member 21 may comprise a proximal linear segment 211 and a distal linear segment 212, which is shown in FIG. 8. The output head 22 is terminally connected to the proximal linear segment 211, while the distal linear segment 212 is terminally connected to the proximal linear segment 211, opposite the output head 22, which allows the leading edge for a longer piece of printed paper to travel first past the output head 22, then past the proximal linear segment 211, and then onto the distal linear segment 212. The distal linear segment 212 is preferably much longer than the proximal linear segment 211. Moreover, the distal linear segment 212 is oriented at an obtuse angle 213 with the proximal linear segment 211 so that the distal linear segment 212 is oriented upwards and consequently prevents a longer piece of printed paper from falling out of the catch tray 72 by slanting the longer piece of printed paper back into the catch tray 72.

Figure 6:
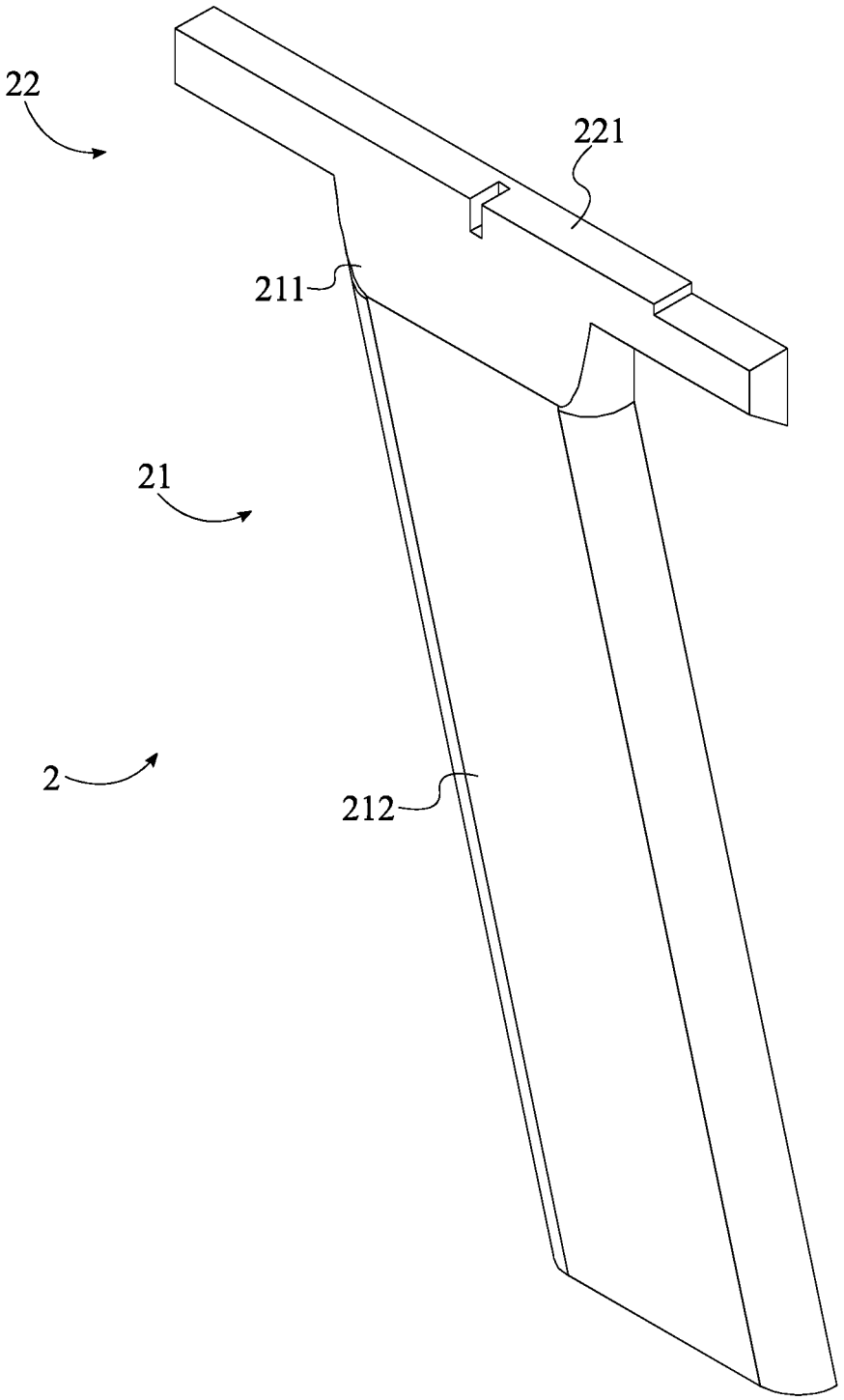
FIG. 6 is a rear perspective view of the output extension part.
Figure 7:
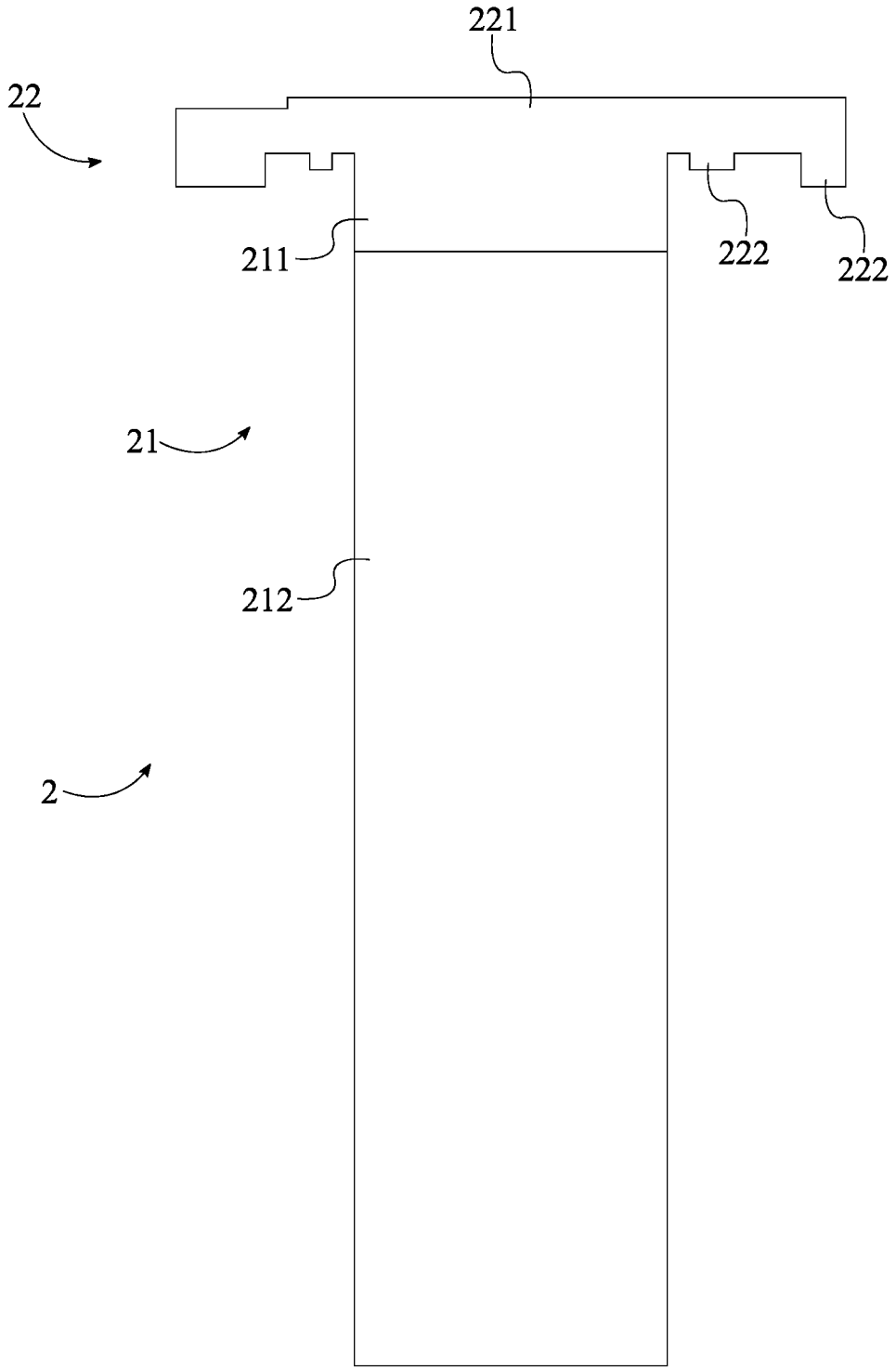
FIG. 7 is a front view of the output extension part.

In order to properly attach the output head 22 onto the desktop printer 7, the output head 22 may comprise a wedge 221 and a plurality of locking teeth 222, which is shown in FIGS. 5, 6, and 7. The wedge 221 and the plurality of locking teeth 222 are both used to engage into the catch tray 72. The wedge 221 is preferably used to be lodged into a lateral elongated cavity in a rear access panel of the OKI B432dn printer. The output elongated member 21 is central positioned along the wedge 221 so that the load pressed against the output elongated member 21 is evenly distributed onto the wedge 221. Moreover, the plurality of locking teeth 222 is laterally connected to the wedge 221 and is distributed along the wedge 221 in order to prevent any transverse movement of the wedge 221 within and along the lateral elongated cavity.

Figure 10:
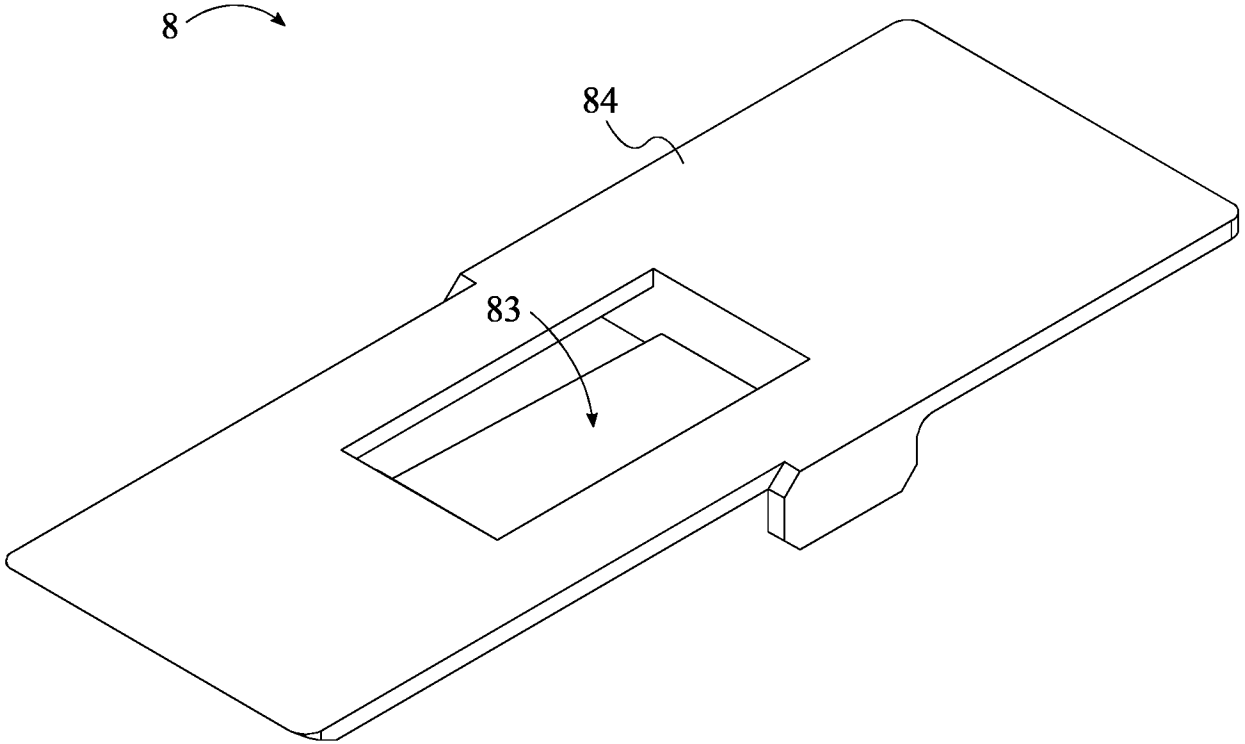
FIG. 10 is a perspective view of the output extension clip.
Figure 11:
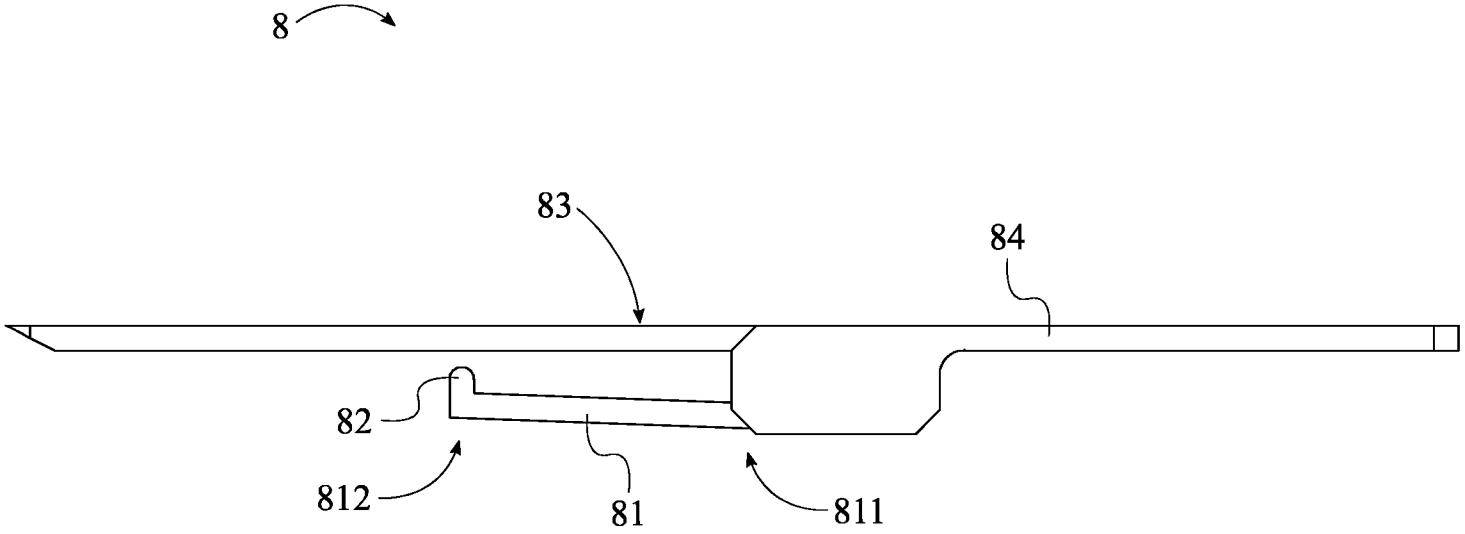
FIG. 11 is a right-side view of the output extension clip.

In order for the output extension clip 8 to be secured to the output paper catch 73 and with reference to FIGS. 10 and 11, the output extension clip 8 comprises a clip arm 81, a clip barb 82, a pressure-increasing hole 83, and an elongated flat body 84. The clip arm 81 comprises a fixed arm end 811 and a free arm end 812. The pressure-increasing hole 83 traverses normal through the elongated flat body 84. The pressure-increasing hole 83 allows the output extension clip 8 to easily slide along the output paper catch 73. The clip arm 81 is positioned across the pressure-increasing hole 83. This arrangement allows the clip arm 81 and clip barb 82 to apply a force onto the output paper catch 73 when engaged by the output extension clip 8. The fixed arm end 811 is connected onto the elongated flat body 84, adjacent to the pressure-increasing hole 83. Thus, one end of the clip arm 81 is fixed which prevents the output paper catch 73 from sliding too far along the output extension clip 8. The clip barb 82 is connected onto the clip arm 81, adjacent to the free arm end 812, and the clip barb 82 is oriented towards the pressure-increasing hole 83. This arrangement allows the clip barb 82 and the clip arm 81 to work in conjunction to apply a force onto the output paper catch 73 when engaged by the output extension clip 8. Thus, the output extension clip 8 can be secured to the output paper catch 73.

Alternative Description

The present invention is a tray extension kit which allows the user to print papers up to a length of 20 inches with the OKI B432dn printer. The tray extension kit consists of two pieces, a main tray extension and a catch tray extension. A normal OKI B432dn printer can only print paper up to a length of 14 inches. This tray extension kit allows the OKI B432dn printer to print paper with a length up to 20 inches. The main tray of the OKI B432dn printer comprises a slide which allows the main tray to receive paper with a length up to 14 inches. By removing the slide and positioning the main tray extension, the user can place paper of up to 20 inches in length on the main tray. The catch tray extension of the tray extension kit allows the catch tray of the OKI B432dn to receive the longer sizes of paper so the printed paper does not fall on the floor.

The present invention is a tray extension kit for the OKI B432dn printer. The tray extension kit allows users to print paper longer than 14 inches up to a length of 20 inches with the OKI B432dn printer. In the preferred embodiment of the present invention, the tray extension kit comprises a first extension and a second extension. The first extension of the tray extension kit further comprises a head and a body. The head of the first extension further comprises a first portion and a second portion. The body of the first extension further comprises a first end, a second end, a plurality of channels, front, and a back. The second extension of the tray extension kit further comprises a head and a body. The head of the second extension further comprises a first portion, a second portion, and a plurality of protrusions. The body of the second extension further comprises a first end, a second end, a plurality of channels, a front, and a back.

In the preferred embodiment of the present invention, the tray extension kit comprises a first extension. The first extension kit of the tray extension kit is positioned on the main tray of the OKI B432dn printer and allows users to place a plurality of paper longer than 12 inches on the main tray. The first extension of the tray extension kit comprises a head and a body. The head of the first extension comprises a first portion and a second portion. The first portion of the head is positioned closed to the top horizontal edge of the second portion and is attached to the second portion orthogonally. In the preferred embodiment of the present invention, the first portion of the head of the first extension is a trapezoidal protrusion with a height lower than the length of the second portion and a thickness equal or smaller than the thickness of the second portion of the head. The second portion of the head comprises a wider top section and thinner bottom section. The body of the first extension is attached to the head at the thinner section of the second portion of the head. In the preferred embodiment of the present invention, the body of the first extension is a long, thin protrusion with a plurality of channels. The first end of the body is attached to the thinner section of the second portion of the head. The second end is positioned across the first end of the body of the first extension. In the preferred embodiment of the present invention, the body of the first extension further comprises a plurality of channels on the front and back surfaces. In the preferred embodiment of the present invention, the plurality of channels on the body of the first extension matches the plurality of protrusions on the top surface of the main tray of the OKI B432dn printer. The first extension may be made from rigid, moldable material including, but not limited to, plastics, metals, etc. In alternate embodiments of the present invention, the first extension of the tray extension kit further comprises additional components which allow the user to further extend the length of the first extension to use longer papers with the OKI B432dn printer.

In the preferred embodiment of the present invention, the tray extension kit further comprises a second extension. The second extension of the tray extension kit is positioned on the catch tray of the OKI B432dn printer and prevents the longer printed papers from falling to the floor. The second extension of the tray extension kit comprises a head and a body. The head of the second extension comprises a first portion and a second portion. The first portion of the head is a semi-rectangular protrusion with a plurality of protrusion of rectangular shape protruding from the bottom surface of the first portion. The first portion of the head is attached to the second portion at the lower horizontal edge of the first portion and top edge of the second portion. The second portion of the head is a rectangular, thin portion positioned under the first portion. The back of the second portion further comprises a plurality of channels which match the plurality of channels on the back of the body of the second extension. The body of the second extension is attached to the lower edge of the second portion of the head at an angle. In the preferred embodiment of the present invention, the body of the second extension is a long, thin, rectangular protrusion with a plurality of channels on the back surface. The body of the second extension comprises a first end and a second end. In the preferred embodiment of the present invention, the plurality of protrusions on the first portion of the head of the second extension matches the plurality of protrusions on the multi-purpose tray door inside surface. In alternate embodiments of the present invention, the second extension of the tray extension kit further comprises additional features which allow the second extension to further extend its length to receive longer sizes of paper.

In the preferred embodiment of the present invention, the tray extension kit comes in a sealed package with instructions to guide the user through the easy and quick installation process. To install the first extension of the tray extension kit on the OKI B432dn printer, the user removes the main tray from the body of the OKI B432dn printer. The user then proceeds to remove the slide from the main tray and slides the body of the first extension into the channel where the slide was positioned. The plurality of channels on the back surface of the body of the first extension allow the user to easily slide in the first extension where the slide was positioned on the main tray. Once installed, the user replaces the main tray back into the body of the OKI B432dn printer. To install the second extension of the tray extension kit on the OKI B432dn printer, the user opens the door of the multi-purpose tray on the back of the OKI B432dn printer. The plurality of protrusions on the first portion of the head of the second extension are matched with the plurality of protrusions on the inside surface of the door of the multi-purpose tray. Once the second extension is locked in place, the user closes the door of the multi-purpose tray to secure in place the second extension. The body of the second extension is left protruding out of the multi-purpose tray at an angle to receive the longer papers and prevent the papers from falling to the floor. In the preferred embodiment of the present invention, the tray extension kit is a retrofit attachment to the OKI B432dn printer. In alternate embodiments of the present invention, the tray extension kit may be integrated into the body of the OKI B432dn printer. In alternate embodiments of the present invention, the tray extension kit may comprise an alternate structure which allows the first extension and second extension to be installed on different versions of the OKI data printers.

Although the invention has been explained in relation to its preferred embodiment, it is to be understood that many other possible modifications and variations can be made without departing from the spirit and scope of the invention as hereinafter claimed.

What is claimed is:

1. A system for a printer extension kit comprises:
a desktop printer;
an input extension part;
an output extension part;
an output extension clip;
the desktop printer comprises a paper tray, a catch tray, and an output paper catch;
the input extension part comprises an input elongated member and an input head;
the output extension part comprises an output elongated member and an output head;
the input elongated member laterally traversing into the paper tray;
the input head being terminally connected to the input elongated member, opposite the paper tray;
the input elongated member being slidably engaged across the paper tray;
the output elongated member being peripherally positioned to the catch tray;
the output head being terminally connected to the output elongated member;
the output head being laterally mounted to the catch tray;
the output head comprises a wedge and a plurality of locking teeth;
the output elongated member being centrally positioned along the wedge;
the plurality of locking teeth being laterally connected to the wedge;
the plurality of locking teeth being distributed along the wedge;
the wedge and the plurality of locking teeth being engaged into the catch tray; and
the output extension clip being attached along the output paper catch.

2. The system for a printer extension kit as claimed in claim 1 comprises:
the input head comprises a stop panel;
the input elongated member being positioned normal to the stop panel; and
the input elongated member being peripherally connected to the stop panel.

3. The system for a printer extension kit as claimed in claim 2 comprises:
the input head further comprises a first counterfort and a second counterfort;
the first counterfort being connected in between the input elongated member and the stop panel;
the second counterfort being connected in between the input elongated member and the stop panel; and
the first counterfort and the second counterfort being positioned opposite to each other about the input elongated member.

4. The system for a printer extension kit as claimed in claim 1 comprises:
a first guide track;
a second guide track;
the first guide track being laterally integrated along the input elongated member;
the first guide track being slidably engaged by the paper tray;
the second guide track being laterally integrated along the input elongated member;
the second guide track being slidably engaged by the paper tray; and
the first guide track and the second guide track being positioned opposite to each other about the input elongated member.

5. The system for a printer extension kit as claimed in claim 1 comprises:
a plurality of guide channels;
the plurality of guide channels being positioned parallel, coplanar, and offset from each other;
the plurality of guide channels being laterally integrated along the input elongated member; and
the plurality of guide channels being slidably engaged onto the paper tray.

6. The system for a printer extension kit as claimed in claim 1 comprises:
the output elongated member comprises a proximal linear segment and a distal linear segment;
the output head being terminally connected to the proximal linear segment;
the distal linear segment being terminally connected to the proximal linear segment, opposite the output head; and
the distal linear segment being oriented at an obtuse angle with the proximal linear segment.

7. The system for a printer extension kit as claimed in claim 1 comprises:
the output extension clip comprises a clip arm, a clip barb, a pressure-increasing hole, and an elongated flat body;
the clip arm comprises a fixed arm end and a free arm end;
the pressure-increasing hole traversing normal through the elongated flat body;
the clip arm being positioned across the pressure-increasing hole;
the fixed arm end being connected onto the elongated flat body, adjacent to the pressure-increasing hole;
the clip barb being connected onto the clip arm, adjacent to the free arm end; and
the clip barb being oriented towards the pressure-increasing hole.

* * * * *